US006349701B1

(12) United States Patent
Sakurai et al.

(10) Patent No.: US 6,349,701 B1
(45) Date of Patent: Feb. 26, 2002

(54) THROTTLE CONTROL APPARATUS FOR INTERNAL COMBUSTION ENGINE

(75) Inventors: Toru Sakurai; Tsutomu Nishitani; Sunao Kitamura; Takashi Tsuge, all of Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 09/721,280

(22) Filed: Nov. 22, 2000

(30) Foreign Application Priority Data

Feb. 21, 2000 (JP) ..... 2000-042584

(51) Int. Cl.[7] ..... F02D 9/10; F02D 11/10
(52) U.S. Cl. ..... 123/399; 123/361
(58) Field of Search ..... 123/337, 361, 123/399

(56) References Cited

U.S. PATENT DOCUMENTS 6,067,958 A * 5/2000 Kamimura et al. ..... 123/337
6,279,535 B1 * 8/2001 Matsusaka ..... 123/399

FOREIGN PATENT DOCUMENTS

JP 10159591 A 6/1998
JP 2000-87762 * 3/2000
JP 2000-265861 * 9/2000

* cited by examiner

*Primary Examiner*—Tony M. Argenbright
(74) *Attorney, Agent, or Firm*—Baker Botts L.L.P.

(57) ABSTRACT

A throttle control apparatus for an internal combustion engine in which wear particles due to sliding between components and vibration wear particles produced between components by engine vibrations are prevented from entering the area between a brush of a throttle sensor and a sensor substrate to prevent the occurrence of a contact failure between the brush and the substrate, thereby making it possible to detect an accurate throttle opening. A brush of a sensor unit is secured to an outer end portion of a throttle shaft projecting from a cover, and the sensor unit is accommodated in a sensor chamber formed outside the cover. A gear chamber for accommodating gears and the sensor chamber are isolated from each other by a dust seal. Therefore, wear particles will not enter the sensor chamber and accumulate in the area between the brush and the sensor substrate to cause a contact failure.

9 Claims, 4 Drawing Sheets

THROTTLE CONTROL APPARATUS FOR INTERNAL COMBUSTION ENGINE

BACKGROUND OF THE INVENTION

The present invention relates to a throttle control apparatus for controlling the amount of intake air in an internal combustion engine. More particularly, the present invention relates to an improvement in reliability of a throttle sensor for detecting the degree of opening of a throttle valve.

There have heretofore been motor-driven throttle control apparatus adapted to control the engine speed by opening or closing a throttle valve secured to a throttle shaft with a motor rotating according to a signal from an ECU (Electronic Control Unit) through gears (a reduction gear mechanism). A publicly known throttle control apparatus of this type has a driving gear secured to an output shaft of a motor, a throttle gear secured to a throttle shaft, an intermediate gear intervening between the two gears, a return spring for urging a throttle valve in the direction in which it is closed, a throttle sensor unit (hereinafter referred to as simply "sensor unit") for detecting the degree of opening of the throttle valve, etc. Both ends of the throttle shaft project outward from bearings provided in a throttle body member. A reduction gear mechanism is connected to one end of the throttle shaft. The sensor unit is connected to the other end of the throttle shaft (for example, see Japanese Patent Application Unexamined Publication (KOKAI) No. Hei10-159591).

In the prior art disclosed in the above-mentioned JP(A) Hei10-159591, the reduction gear mechanism is connected to one end of the throttle shaft, and the sensor unit is connected to the other end of the throttle shaft. Therefore, it is necessary to provide a gear case at one end of the throttle shaft and to provide a sensor case at the other end of the throttle shaft. This causes the throttle body to become complicated in structure and the number of components to increase unfavorably. Under these circumstances, an invention was made to improve the prior art disclosed in JP(A) Hei10-159591. With the invention, the reduction gear mechanism, the sensor unit, etc. are disposed at one end of the throttle shaft and accommodated in a single chamber (see Japanese Patent Application Unexamined Publication (Kokai) No. 2000-265861, by the present applicant). In this invention, as shown in FIGS. 2 and 11, a driving gear 20, an intermediate gear 22, a throttle gear 18, a full-closed position adjusting screw 23, a brush 16 for a throttle sensor, a sensor substrate 17, etc. are surrounded by a cover 32 and accommodated in the same chamber.

If the reduction gear mechanism, the sensor unit, etc. are accommodated in a single chamber, sliding wear particles produced between gears or those produced between a spring and a guide contacting it are likely to enter and accumulate in the area between the brush and the substrate (resistor) in the sensor unit, causing a contact failure and making it impossible to detect an accurate throttle opening. One approach to solve this problem is to install the sensor unit, which includes the brush and the substrate, in the vicinity of a throttle bore portion of the throttle shaft and to cover the sensor unit with a lidded cylindrical cover arranged to fit to the throttle body member, thereby preventing sliding wear particles produced between the components from entering the sensor unit. In this case, however, vibration friction particles produced by engine vibrations occurring between the cover and the throttle body member may accumulate in the area between the brush and the substrate, causing a contact failure and making the sensor unit unable to detect an accurate throttle opening. In addition, because the sensor unit is provided in an inner part near the throttle bore, it is difficult to perform an operation for measuring the brush pressing force during the assembly of the throttle body. Therefore, the number of man-hours needed to carry out the operation increases, causing the assembling cost to be increased.

SUMMARY OF THE INVENTION

A first object of the present invention is to provide a throttle control apparatus for an internal combustion engine in which wear particles due to sliding between components and vibration wear particles produced between components by engine vibrations are prevented from entering the area between a brush of a throttle sensor and a sensor substrate (resistor) to prevent the occurrence of a contact failure between the brush and the substrate, thereby making it possible to detect an accurate throttle opening. A second object of the present invention is to reduce the number of man-hours needed to carry out the assembling operation and to thereby reduce the assembling cost.

A third object of the present invention is to provide a throttle control apparatus for an internal combustion engine in which a sensor chamber is formed outside a cover for a gear chamber to accommodate a sensor unit, and a breather opening is provided in the wall of the sensor chamber. The throttle control apparatus is designed to prevent wear particles in the gear chamber, when entering the sensor chamber through the breather opening, from adhering to the sensor unit in the sensor chamber. A fourth object of the present invention is to prevent the breather opening from being clogged with drops of water entering the sensor chamber or the gear chamber.

The present invention is applied to a throttle control apparatus for an internal combustion engine in which a throttle shaft rotatably provided across an intake passage is rotatively driven by a motor through gears (reduction gear mechanism) to open or close a throttle valve secured to the throttle shaft, thereby controlling the amount of intake air. According to a first aspect of the present invention, a brush of a sensor unit for detecting a degree of opening of the throttle valve is secured to an outer end portion of the throttle shaft projecting from a cover, and the sensor unit is accommodated in a sensor chamber formed outside the cover and isolated by a seal member from a gear chamber for accommodating the gears. With the arrangement according to the first aspect of the present invention, a sensor chamber is constructed of a cover and a plate separately from the gear chamber, and the sensor unit is accommodated in the sensor chamber. Therefore, wear particles due to sliding and vibrations occurring in the gear chamber will not enter the sensor chamber and accumulate in the area between the brush and the sensor substrate to cause a contact failure. Accordingly, the throttle opening detecting capability will not degrade, and it is possible to detect an accurate throttle opening.

According to a second aspect of the present invention, the brush of the sensor unit in the first arrangement is secured to the outer side of a brush lever to extend outward. With the arrangement according to the second aspect of the present invention, because the brush is secured to the outer side of the brush lever to extend outward, it becomes easy to measure the brush pressing force during the assembly of the throttle body. Accordingly, it is possible to reduce the number of man-hours needed to perform the assembling operation and hence possible to reduce the assembling cost.

According to a third aspect of the present invention, a breather opening is provided in the wall of the sensor chamber for accommodating the sensor unit in the first and second arrangements. With the arrangement according to the third aspect of the present invention, because a breather opening is provided in the wall of the sensor chamber for accommodating the sensor unit, it is possible to prevent the brush and the sensor substrate from being corroded by a corrosive gas generated from a synthetic resin or rubber material used in the sensor chamber by scavenging the corrosive gas through the breather opening.

According to a fourth aspect of the present invention, a fixed shaft for an intermediate gear is supported at both ends thereof by a throttle body member and the cover in the first to third arrangements. With the arrangement according to the fourth aspect of the present invention, because both ends of the fixed shaft for the intermediate gear are supported, driving force from a driving gear is halved by bearing portions for the two ends of the shaft. Accordingly, the length to which the fixed shaft is press-fitted into the throttle body member can be reduced to half. In addition, the amount of distortion of the fixed shaft reduces by half, and the amount of sliding between the gears also reduces. Consequently, the amount of wear particles due to sliding reduces, and the durability of the gears is improved.

According to a fifth aspect of the present invention, a breather opening is provided at a position facing a position laterally away from a resistor buried in the sensor substrate in the first arrangement. With the arrangement according to the fifth aspect of the present invention, because the breather opening is provided at a position facing a position laterally away from the resistor buried in the sensor substrate, when wear particles in the gear chamber enter the sensor chamber through the breather opening, the wear particles are unlikely to adhere to the resistor. Thus, the effect of wear particles on the sensor output signal is reduced.

According to a sixth aspect of the present invention, the breather opening is provided at a position facing a position away from a brush position when the throttle valve is fully open, which is less frequently used than a brush position when the throttle valve is fully closed, to the outside of the movable range of the brush in the third or fifth arrangement. With the arrangement according to the sixth aspect of the present invention, the breather opening is provided at a position facing a position away from a brush position when the throttle valve is fully open, which is less frequently used than a brush position when the throttle valve is fully closed, to the outside of the movable range of the brush. Accordingly, when wear particles in the gear chamber enter the sensor chamber through the breather opening, the wear particles will adhere to a non-used portion of the resistor (a portion which the brush will not contact) or to a portion of the resistor that is least frequently used. Therefore, the effect of wear particles on the sensor output signal is reduced. In addition, because wear particles will adhere to the non-used portion of the resistor or the least frequently used portion thereof, it is possible to prevent wear particles from being scattered over the whole area of the sensor substrate, including the resistor, by the brush.

According to a seventh aspect of the present invention, an auxiliary hole larger in diameter than the breather opening is formed at either or each of the sensor chamber side of the breather opening and the gear chamber side of the breather opening in the third arrangement in such a manner that a step portion is interposed between the breather opening and the auxiliary hole. With the arrangement according to the seventh aspect of the present invention, an auxiliary hole larger in diameter than the breather opening is formed at either or each of the sensor chamber side of the breather opening and the gear chamber side of the breather opening with a step portion interposed therebetween. Therefore, when drops of water entering the gear chamber or the sensor chamber move along the sensor chamber wall, the water drops are trapped in the auxiliary hole and the step portion and prevented from reaching the breather opening. Thus, the breather opening is prevented from being clogged with water. Accordingly, the discharge of a corrosive gas from the sensor chamber will not be obstructed.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
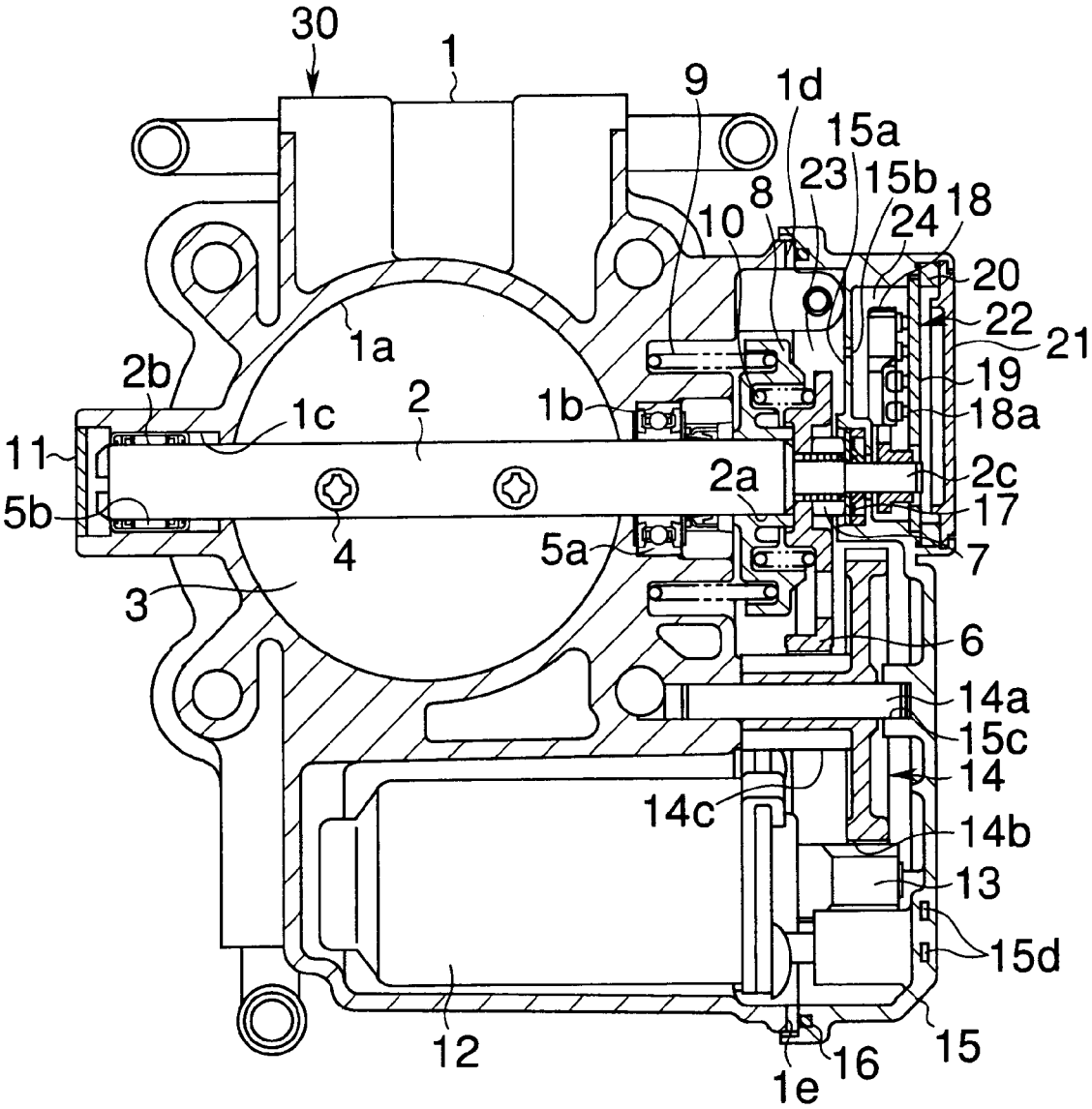
FIG. 1 is a sectional view showing a first embodiment of the throttle control apparatus for an internal combustion engine according to the present invention.
Figure 2:
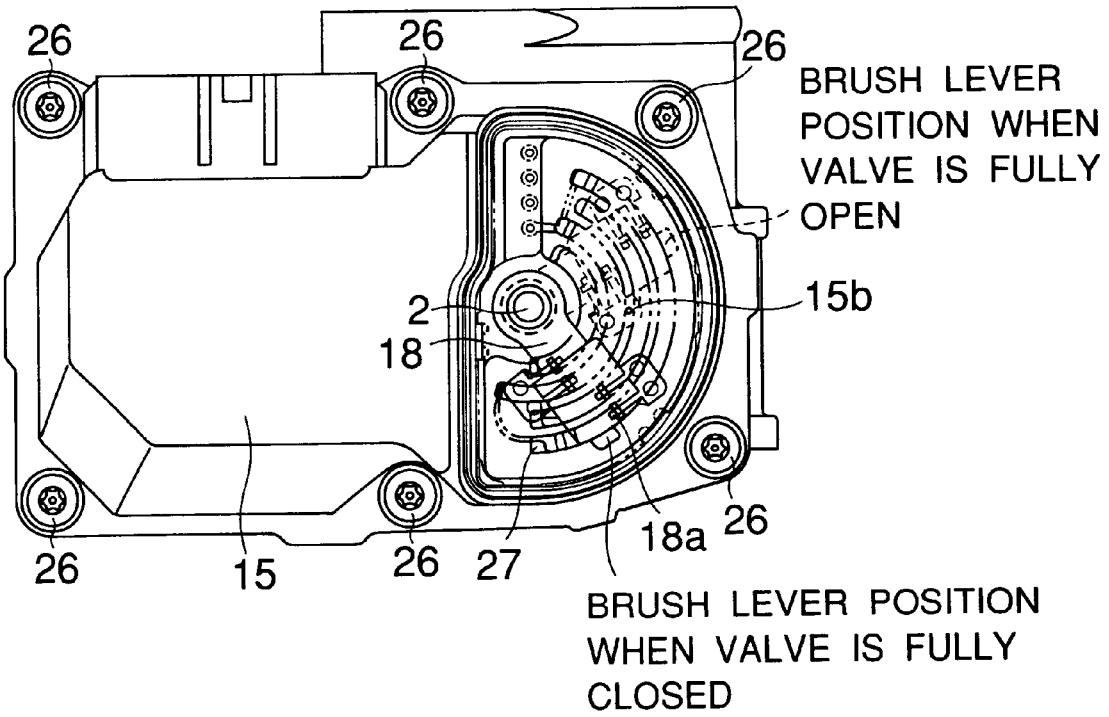
FIG. 2 is a right-hand side view of the throttle control apparatus shown in FIG. 1 (rotated clockwise through 90°).

FIGS. 1 and 2 show a first embodiment of the throttle control apparatus for an internal combustion engine according to the present invention. In FIGS. 1 and 2, a throttle body member 1 has an intake passage 1*a* provided in the center thereof. A throttle shaft 2 is rotatably fitted across the intake passage 1*a*. A throttle valve 3 is secured to the throttle shaft 2 with screws 4. The throttle shaft 2 is rotatably held by bearings 5*a* and 5*b* fitted in respective bearing portions 1*b* and 1*c* of a cylindrical inner surface of the throttle body member 1. A throttle gear 6 is fitted on one end portion 2*a* (the right-hand end in FIG. 1) of the throttle shaft 2 and secured with a nut 7 to form an integral detent structure. A relief lever 8 is loosely fitted on the outer periphery of the throttle shaft 2. The relief lever 8 is engaged with the throttle gear 6.

A coil spring 9 is fitted between the relief lever 8 and the throttle body member 1. The coil spring 9 urges the throttle valve 3 in the direction in which it is closed. Further, a coil spring 10 is fitted between the throttle gear 6 and the relief lever 8. The coil spring 10 urges the relief lever 8 in the direction in which it is returned. A plug 11 is fitted into a cylindrical portion of the throttle body member 1 at the other end (the left-hand end in FIG. 1), whereby the other end portion 2*b* of the throttle shaft 2 is sealed in the throttle body member 1. A motor 12 is secured to the throttle body member 1 in parallel to the axis of the throttle shaft 2. A driving gear 13 is fitted on the distal end portion of an output rotating shaft of the motor 12 and integrally secured thereto. The proximal end of a fixed shaft 14*a* is press-fitted into the throttle body member 1 and thus fixed. An intermediate gear 14 is rotatably installed on the outer periphery of the fixed shaft 14*a*. A large-diameter portion 14*b* of the intermediate gear 14 is meshed with the driving gear 13. The throttle gear 6 is meshed with a small-diameter portion 14*c* of the intermediate gear 14.

A cover 15 covers the gears 6, 13 and 14, the relief lever 8, the coil springs 9 and 10, etc. The cover 15 is attached to the throttle body member 1 in such a manner as to keep airtightness by using a seal ring (O-ring) 16. An outer end portion 2*c* of the throttle shaft 2 projects from a through-hole in the cover 15 and is sealed with a dust seal 17 to prevent entry of dust. A brush lever 18 is fitted and secured to the outer end portion 2*c* of the throttle shaft 2. Four brushes 18*a* made of an electrically conducting elastic material are integrally fixed to the brush lever 18. The brushes 18*a* are fixed to the outer side (the right-hand side in FIG. 1) of the brush lever 18 to extend outward. A sensor substrate 19 is installed at a position facing the brushes 18*a*. The sensor substrate 19 has four resistors 27 (see FIG. 2) buried therein. The resistors 27 each have an arcuate shape corresponding to the locus of movement of each brush 18*a*. The distal ends of the four brushes 18*a* are constantly kept in contact with the respective resistors 27 under pressure. The sensor substrate 19 is placed to abut on the cover 15 and secured thereto by a plate 21 with an elastic packing 20 interposed therebetween. The plate 21 is secured to the cover 15 by welding. It should be noted that, as shown in FIG. 2, the cover 15 is secured to the throttle body member 1 with six bolts 26.

Wires (not shown) for outputting a resistance value (detected opening value) of the resistors 27 on the sensor substrate 19 are led out from a connector portion (not shown) integrally formed with the cover 15. With the above-described arrangement, a sensor unit 22 formed from the brushes 18*a* and the sensor substrate 19 is accommodated in a sensor chamber 24 formed by the cover 15 and the plate 21 and isolated from a gear chamber (gear train chamber) 23 by a sensor chamber wall 15*a* of the cover 15. A breather opening 15*b* is provided in an approximately central portion of the sensor chamber wall 15*a* to let air (gas) escape from the sensor chamber 24. The breather opening 15*b* may be provided according to the amount of corrosive gas components generated from a synthetic resin or rubber material used in the sensor chamber 24. When the breather opening 15*b* is provided, the effect of preventing the entry of wear particles is slightly weakened.

It should be noted that where the breather opening 15*b* is provided is not necessarily limited to the sensor chamber wall 15*a*. The breather opening 15*b* may be provided in the cover 15 or the plate 21 to let a gas escape directly to the atmosphere. In addition, a breather opening 1*d* for the gear chamber 23 is provided in the upper portion of the throttle body member 1, and a drainage hole 1*e* is provided in the lowermost portion of the throttle body member 1 to let water flow out of the gear chamber 23 if water enters it. It should be noted that the seal ring 16 may be omitted when the throttle control apparatus is installed in a vehicle in such a manner that it is not splashed with water. The distal end of the fixed shaft 14*a* for the intermediate gear 14 is fitted in a shaft hole 15*c* provided in the cover 15. Thus, the fixed shaft 14*a* is supported at both ends thereof by the cover 15 and the throttle body member 1. The supply of an output signal (electric signal) to the motor 12 is carried out through electrodes 15*d* from the connector portion (not shown) integrally formed with the cover 15.

Next, the operation of the first embodiment of the present invention will be described. When an electric signal from an ECU (not shown) is supplied to the motor 12 through the electrodes 15*d*, the motor 12 rotates according to the electric signal, causing the large-diameter portion 14*b* of the intermediate gear 14 to rotate through the driving gear 13 provided on the distal end portion of the motor driving shaft. Consequently, the throttle gear 6 meshed with the small-diameter portion 14*c* of the intermediate gear 14 rotates to open or close the throttle valve 3. Because the fixed shaft 14*a* for the intermediate gear 14 is supported at both ends thereof by the throttle body member 1 and the cover 15, driving force from the driving gear 13 is halved by bearing portions for the two ends of the fixed shaft 14*a*. Accordingly, the length to which the fixed shaft 14*a* is press-fitted into the throttle body member 1 can be reduced to half. Further, because the amount of distortion of the fixed shaft 14*a* reduces by half, the amount of sliding between the gears also reduces. Consequently, the amount of wear particles due to sliding reduces, and the durability of the gears is improved.

Wear particles produced by sliding or vibrations of the gears 13, 14 and 6 and the coil springs 9 and 10 are blocked by the sensor chamber wall 15*a* and the dust seal 17 and thus prevented from entering the sensor chamber 24. Consequently, the amount of wear particles accumulated in the area between the brushes 18*a* and the sensor substrate 19 reduces extremely. From the viewpoint of effectively preventing the entry of wear particles, it is preferable not to provide the breather opening 15*b* in the sensor chamber wall 15*a*. However, it is necessary to provide the breather opening 15*b* according to the condition of generation of corrosive gas components from a synthetic resin or rubber material used in the sensor chamber 24. When the breather opening 15*b* is provided, the air in the sensor chamber 24 can be circulated in cooperation with the dust seal 17. Accordingly, it becomes possible to replace the air in the sensor chamber 24 with fresh air. Because the brush lever 18 is secured to the outer end portion 2*c* of the throttle shaft 2, that is, outside the cover 15, and the brushes 18*a* are secured to the outer side of the brush lever 18 to extend outward, pressing force with which the brushes 18*a* are pressed against the sensor substrate 19 can be measured efficiently within a short period of time when the throttle body 30 is assembled. Accordingly, it is possible to reduce the number of man-hours needed to perform the assembling operation.

In the first embodiment of the present invention, the breather opening 15*b* is formed at a position facing an approximately central portion of the arcuate resistors (sensor resistors) 27 (i.e. an approximately central position on the sensor chamber wall 15*a*). As shown in FIG. 2, the position of the breather opening 15*b* corresponds to the middle between the position of the brush lever 18 when the throttle valve is fully closed and the position of the brush lever 18 when the throttle valve is fully open. Thus, because the breather opening 15*b* is present in a portion facing portions of the resistors 27 that are used very frequently, if wear particles in the gear chamber 23 enter the sensor chamber 24 through the breather opening 15*b*, the wear particles adhere to portions of the resistors 27 that are used very frequently. Therefore, there is a strong possibility of the sensor output signal becoming abnormal.

Furthermore, in the first embodiment of the present invention, the breather opening 15*b* is a circular hole perpendicular to the surface of the sensor chamber wall 15*a*. Therefore, when drops of water entering the gear chamber 23 or the sensor chamber 24 move along the sensor chamber wall 15*a*, the water drops may flow into the circular hole and clog it. If the circular hole is clogged with water drops, it becomes impossible to discharge a corrosive gas from the sensor chamber 24, and it becomes likely that the resistors 27 and the brushes 18*a* may be corroded by the corrosive gas.

Figure 3A:
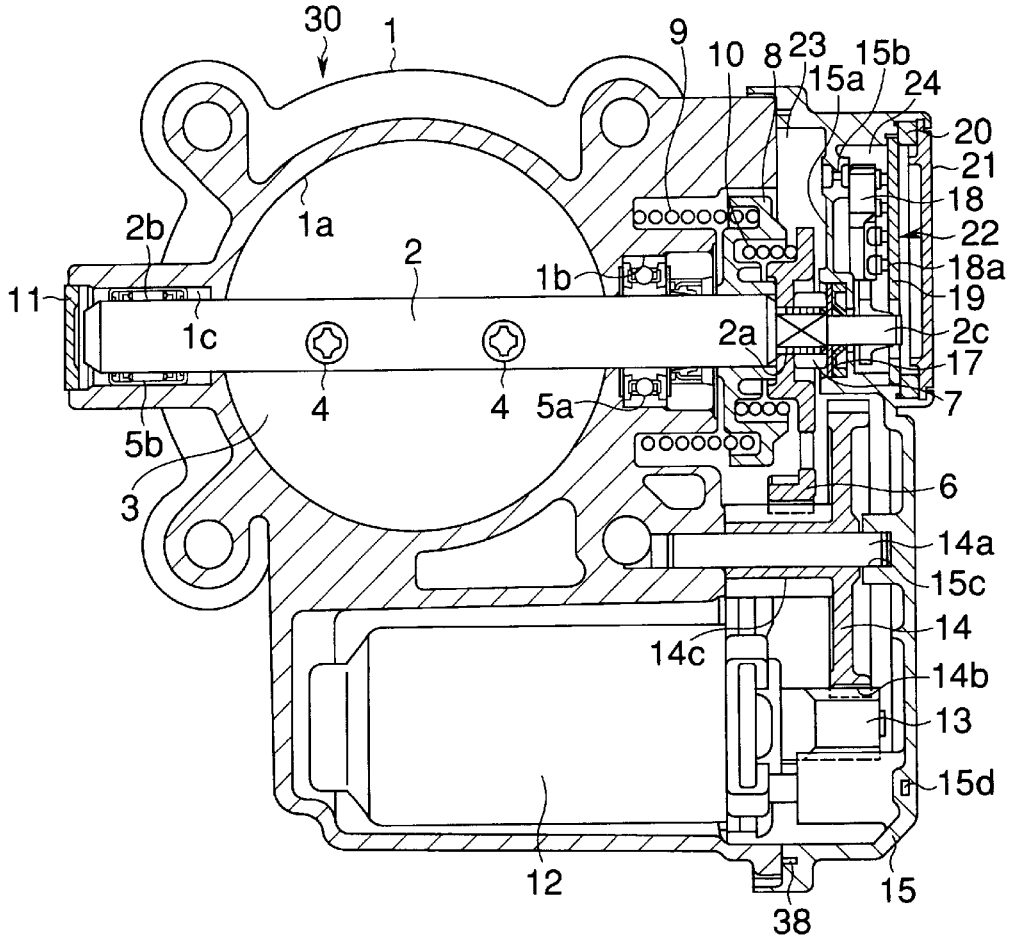
FIG. 3A is a sectional view showing a second embodiment of the throttle control apparatus for an internal combustion engine according to the present invention.
Figure 3B:
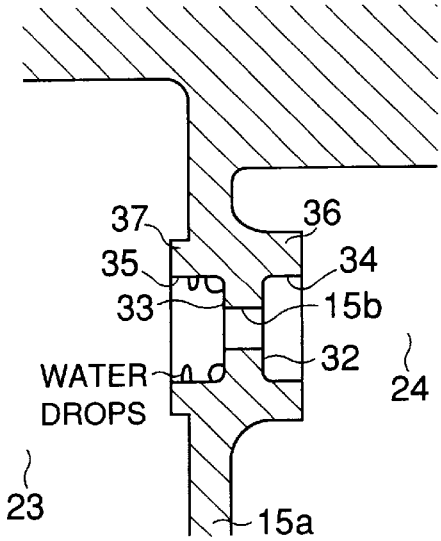
FIG. 3B is an enlarged view of a breather opening portion of the throttle control apparatus shown in FIG. 3A.
Figure 4:
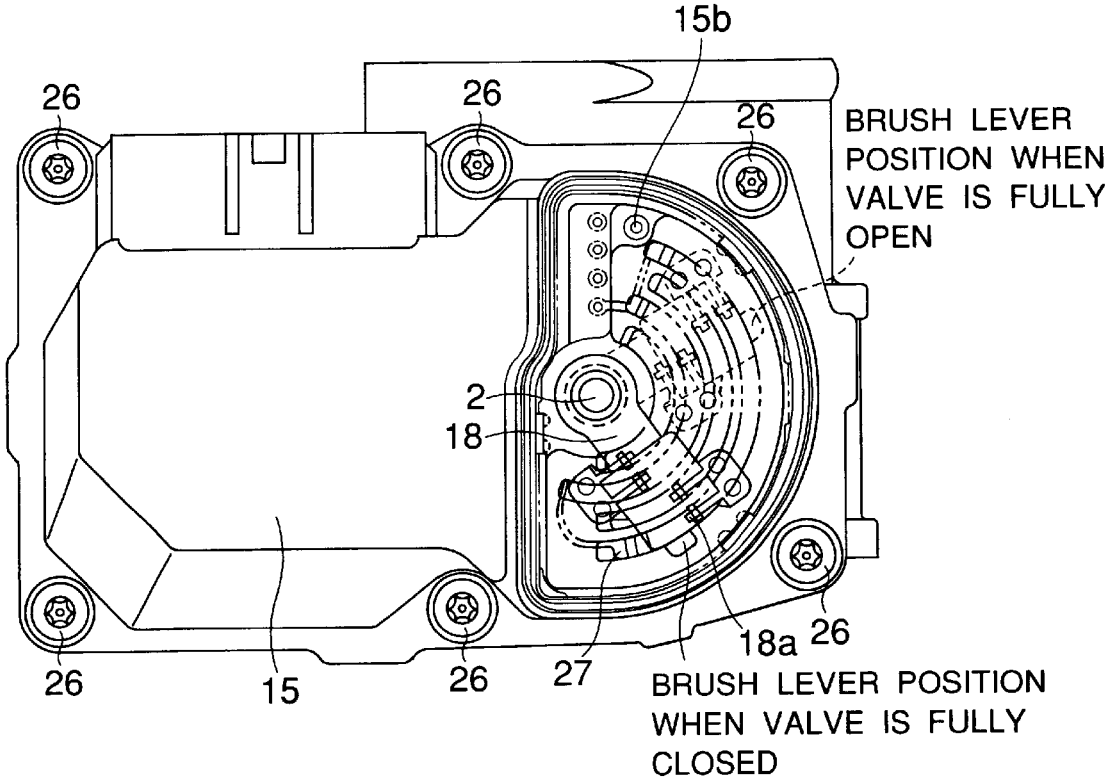
FIG. 4 is a right-hand side view of the throttle control apparatus shown in FIG. 3A (rotated clockwise through 90°).

FIGS. 3 and 4 show a second embodiment of the throttle control apparatus for an internal combustion engine according to the present invention. The second embodiment overcomes the above-described disadvantages associated with the breather opening 15*b* in the first embodiment of the present invention. The feature of the second embodiment resides in the position and configuration of the breather opening (hole) 15*b*. In the following description of the second embodiment, members similar to those in the first embodiment are denoted by the same reference numerals as those in the first embodiment, and a description thereof is omitted.

As shown clearly in FIGS. 3 and 4, the breather opening 15*b* in the second embodiment is opened in the upper end portion of the sensor chamber 24. The position of the breather opening 15*b* faces a portion of the sensor substrate 19 that is away from the resistors 27 in a lateral direction (with respect to the sensor substrate 19). Moreover, the position of the breather opening 15*b* faces a portion of the sensor substrate 19 that is away from a brush position when the throttle valve is fully open, which is less frequently used than a brush position when the throttle valve is fully closed, to the outside of the movable range of the brush lever 18 and the brushes 18*a*.

Thus, the breather opening 15*b* is provided at a position facing a portion of the sensor substrate 19 that is most unrelated to positions where the brushes 18*a* may be used. Therefore, when wear particles in the gear chamber 23 enter the sensor chamber 24 through the breather opening 15*b*, the wear particles adhere to non-used portions of the resistors 27 (i.e. portions which the brushes 18*a* will not contact) or portions of the resistors 27 that are least frequently used. Thus, the effect of wear particles on the sensor output signal is reduced. Furthermore, because wear particles adhere to the non-used portions of the resistors 27 or the least frequently used portions thereof, it is possible to prevent wear particles from being scattered over the whole area of the sensor substrate 19, including the resistors 27, by the brushes 18*a*. It should be noted that reference numeral 38 denotes a sump groove.

As shown clearly in FIG. 3B, in the second embodiment, auxiliary holes 34 and 35 larger (2 to 3 times larger) in diameter than the breather opening 15*b* are formed at both the sensor chamber 24 side of the breather opening 15*b* and the gear chamber 23 side of the breather opening 15*b*, and step portions 32 and 33 perpendicular to the axis of the breather opening 15*b* are interposed between the breather opening 15*b* and the auxiliary holes 34 and 35. It should be noted that such an auxiliary hole may be formed only at either of the sensor chamber 24 side of the breather opening 15*b* and the gear chamber 23 side of the breather opening 15*b*. In this embodiment, because the axial length of the breather opening 15*b* is equal to the thickness of the sensor chamber wall 15*a*, the auxiliary holes 34 and 35 are mainly formed inside respective cylindrical portions 36 and 37, and the auxiliary holes 34 and 35 have the same diameter. In a case where there is no possibility of water drops entering the gear chamber 23, the step portion 33, the auxiliary hole 35 and the cylindrical portion 37 provided at the gear chamber 23 side can be omitted. In a case where there is no possibility of water drops entering the sensor chamber 24, the step portion 32, the auxiliary hole 34 and the cylindrical portion 36 provided at the sensor chamber 24 side can be omitted.

By virtue of the presence of the step portions 32 and 33 and the auxiliary holes 34 and 35, when drops of water entering the gear chamber 23 or the sensor chamber 24 move along the sensor chamber wall 15*a*, the water drops are trapped in the auxiliary hole 34 or 35 and the step portion 32 or 33 and prevented from reaching the breather opening 15*b*. Thus, the breather opening 15*b* is prevented from being clogged with water. Accordingly, the discharge of a corrosive gas from the sensor chamber 24 will not be obstructed.

It should be noted that the present invention is not necessarily limited to the foregoing embodiments but can be modified in a variety of ways without departing from the gist of the present invention.

What is claimed is:

1. In a throttle control apparatus for an internal combustion engine wherein a throttle shaft rotatably provided across an intake passage is rotatively driven by a motor through gears to open or close a throttle valve secured to said throttle shaft, thereby controlling an amount of intake air, the improvement wherein a brush of a sensor unit for detecting a degree of opening of said throttle valve is secured to an outer end portion of said throttle shaft projecting from a cover, and said sensor unit is accommodated in a sensor chamber formed outside said cover and isolated by a seal member from a gear chamber for accommodating said gears.

2. A throttle control apparatus for an internal combustion engine according to claim 1, wherein said brush of said sensor unit is secured to an outer side of a brush lever to extend outward.

3. A throttle control apparatus for an internal combustion engine according to claim 1, wherein a breather opening is provided in a wall of the sensor chamber for accommodating said sensor unit.

4. A throttle control apparatus for an internal combustion engine according to claim 2, wherein a breather opening is provided in a wall of the sensor chamber for accommodating said sensor unit.

5. A throttle control apparatus for an internal combustion engine according to claim 1, wherein a fixed shaft for an intermediate gear is supported at both ends thereof by a throttle body member and said cover.

6. A throttle control apparatus for an internal combustion engine according to claim 3, wherein said breather opening is provided at a position facing a position laterally away from a resistor buried in a sensor substrate.

7. A throttle control apparatus for an internal combustion engine according to claim 4, wherein said breather opening is provided at a position facing a position laterally away from a resistor buried in a sensor substrate.

8. A throttle control apparatus for an internal combustion engine according to claim 3, wherein said breather opening is provided at a position facing a position away from a brush position when said throttle valve is fully open, which is less frequently used than a brush position when said throttle valve is fully closed, to an outside of a movable range of said brush.

9. A throttle control apparatus for an internal combustion engine according to claim 3, wherein an auxiliary hole larger in diameter than said breather opening is formed at either or each of a sensor chamber side of said breather opening and a gear chamber side of said breather opening in such a manner that a step portion is interposed between said breather opening and said auxiliary hole.

* * * * *